US006589375B2

(12) United States Patent
Knowlton et al.

(10) Patent No.: US 6,589,375 B2
(45) Date of Patent: Jul. 8, 2003

(54) LOW SOLIDS GAS GENERANT HAVING A LOW FLAME TEMPERATURE

(75) Inventors: Gregory D. Knowlton, Chandler, AZ (US); Christopher P. Ludwig, Fountain Hill, AZ (US); Thomas M. Deppert, Gilbert, AZ (US); Dan McFadden, Chandler, AZ (US); James Dupont, Phoenix, AZ (US); Christian Salafia, Mesa, AZ (US)

(73) Assignee: Talley Defense Systems, Inc., Mesa, AZ (US)

( * ) Notice: Subject to any disclaimer, the term of this patent is extended or adjusted under 35 U.S.C. 154(b) by 313 days.

(21) Appl. No.: 09/798,547

(22) Filed: Mar. 2, 2001

(65) Prior Publication Data

US 2003/0094225 A1 May 22, 2003

(51) Int. Cl.[7] ..... C06B 31/00

(52) U.S. Cl. ..... 149/45; 149/74; 149/88; 149/92

(58) Field of Search ..... 149/45, 74, 88, 149/92

(56) References Cited

U.S. PATENT DOCUMENTS

| | | | | |
|---|---|---|---|---|
| 2,923,612 A | | 2/1960 | Harrison et al. | 52/14 |
| 3,806,461 A | | 4/1974 | Roger et al. | 242/188.3 R |
| 3,837,942 A | | 9/1974 | Catanzarite | 149/83 |
| 3,960,621 A | | 6/1976 | Whitworth et al. | 149/65 |
| 4,298,412 A | | 11/1981 | Biddle et al. | 149/19.5 |
| 4,379,007 A | | 4/1983 | Fifer et al. | 149/22 |
| 4,381,270 A | | 4/1983 | Bjorn et al. | 264/3 B |
| 4,407,119 A | | 10/1983 | Biddle et al. | 60/219 |
| 4,521,261 A | | 6/1985 | Davies | 149/92 |
| 4,552,597 A | | 11/1985 | Abegg et al. | 149/2 |
| 4,600,451 A | | 7/1986 | Jessop et al. | 149/19.3 |
| 4,632,714 A | | 12/1986 | Abegg et al. | 149/2 |
| 5,035,757 A | | 7/1991 | Poole | 149/46 |
| 5,125,684 A | | 6/1992 | Cartwright | 280/736 |
| 5,542,998 A | | 8/1996 | Bucerius et al. | 149/45 |
| 5,542,999 A | | 8/1996 | Bucerius et al. | 149/45 |
| 5,578,785 A | | 11/1996 | Fiederling | 102/202 |
| 5,608,183 A | | 3/1997 | Barnes et al. | 149/45 |
| 5,635,668 A | | 6/1997 | Barnes et al. | 149/45 |
| 5,659,150 A | | 8/1997 | Butt et al. | 102/289 |
| 5,735,118 A | | 4/1998 | Hinshaw et al. | 60/219 |
| 5,780,768 A | | 7/1998 | Knowlton et al. | 149/36 |
| 5,841,065 A | | 11/1998 | Mendenhall | 149/37 |
| 5,882,036 A | | 3/1999 | Moore et al. | 280/736 |
| 5,932,837 A | | 8/1999 | Rusek et al. | 149/1 |
| 5,979,936 A | | 11/1999 | Moore et al. | 280/736 |
| 5,989,367 A | | 11/1999 | Zeuner et al. | 149/47 |
| 6,039,820 A | | 3/2000 | Hinshaw et al. | 149/45 |
| 6,045,637 A | | 4/2000 | Grzyll | 149/19 |
| 6,045,638 A | | 4/2000 | Lundstrom | 149/36 |
| 6,051,158 A | | 4/2000 | Taylor et al. | 252/67 |
| 6,077,372 A | | 6/2000 | Mendenhall et al. | |
| 6,096,147 A | * | 8/2000 | Taylor et al. | 149/3 |

FOREIGN PATENT DOCUMENTS

| | | | | |
|---|---|---|---|---|
| EP | 0949225 | * | 10/1999 | C06D/5/06 |
| FR | WO 99/31029 | * | 6/1999 | C06D/5/06 |

* cited by examiner

*Primary Examiner*—Gregory Delcotto
(74) *Attorney, Agent, or Firm*—Fitzpatrick, Cella, Harper & Scinto

(57) ABSTRACT

A low-solids gas generating composition and a method of generating a gas with low solids by preparing and combusting the low-solids gas generating composition. The compositions of the invention include a mixture of a basic copper nitrate oxidizer and a fuel selected for the group consisting of 5-nitro-uracil, guanidine 5-nitro-uracil salt, ammonium 5-nitro-uracil salt, aminoguanidine 5-nitro-uracil salt, hydrazine 5-nitro-uracil salt, triamino 5-nitro-uracil salt, guanidine 5-nitro-barbituric acid salt, ammonium 5-nitro-barbituric acid salt, hydrazine 5-nitro-barbituric acid salt, aminoguanidine 5-nitro-barbituric acid salt, triaminoguanidine 5-nitro-barbituric acid salt, and mixtures thereof, wherein the oxidizer-fuel mixture is within about 4 percent of stoichiometric balance, and produces no more than about 0.06 cubic centimeters of solids per gram of gas generating composition on combustion. The compositions of the invention may further include at least one of cupric oxalate hemi-hydrate, sub-micron fumed silica, and graphite.

36 Claims, No Drawings

LOW SOLIDS GAS GENERANT HAVING A LOW FLAME TEMPERATURE

FIELD OF THE INVENTION

The invention is directed to gas generant compositions. In particular, the invention is directed to low solids gas generant compositions containing basic copper nitrate, and having a relatively low flame temperature.

BACKGROUND

Single use, i.e., "one shot" gas generators are well known in the art, and have become commonplace for many applications. In general, such gas generators are used to perform work in an emergency or in an a situation requiring the one-time production of a working gas. For such applications, the gas must be provided on demand in a consistent manner with high reliability. That is, the gas must be provided in the amount and at the pressure required, and the gas generator must operate with high reliability when generation of the gas is required. Typical applications include, but are not limited to, inflating automotive air bags, dispersing munitions from a cruise missile with air bags, inflating safety devices, such as buoyancy devices. e.g., life rafts and life preservers, inflating temporary structures, such as airplane escape slides, moving mechanical devices, such as pistons and rotary actuators, and providing inert gas for fire suppression, etc.

Although pressurized gas stored in a pressure vessel may be utilized in certain applications, pressurized gas sources are large and heavy. As a result, many applications may be performed more efficiently and more reliably using a pyrotechnic gas generating device that produces warm or hot gases from the combustion of a pyrotechnic gas generating material. In general, pyrotechnic gas generators produce more energy per unit mass and per unit volume than do compressed gas devices. They are also typically more reliable, as gas may leak out of the pressurized gas systems during storage, resulting in the release of an insufficient amount of gas when the device is finally operated.

The performance requirements of pyrotechnic gas generators vary in accordance with different applications, where the gas produced must meet certain requirements for temperature, toxicity, and corrosiveness. As the choice of pure pyrotechnic gas generators is limited by the selection of gas generant compositions, the development of a gas generant to meet certain performance criteria, such as burn rate, operating pressure, mechanical integrity of the gas generant grains, operational temperature range, and water content, is somewhat of an art. The development of a gas generant generally requires a number of compromises to meet those performance requirements in addition to requirements for gas temperature, toxicity, and corrosiveness. For example, the toxicity and corrosiveness of the effluent gases are of particular concern in many inflatable devices, such as where an inflatable device is used in a confined environment in which humans are present; e.g., automotive air bags. The pyrotechnic gas generants used in such devices often must compromise performance to provide an acceptably low toxicity and corrosiveness in the gas composition.

Inflatable devices also typically require a relatively cool gas to prevent damage to the material from which the inflatable device is fabricated. A relatively cool gas may also be required to keep the inflatable device fully inflated for sustained periods of time, depending on the temperature of the environment. Where the gas used to inflate an inflatable device is significantly hotter than the surrounding environment when the device is initially inflated, the pressure within the device will decrease shortly after the inflation is complete as the gas cools, resulting in at least a partial deflation of the inflated device. Extra gas may be added to the inflatable device to maintain the required inflation pressure after the gas within the device cools. However, the device may be over inflated when the hot gases are initially discharged into the device, potentially rupturing the inflatable device during inflation.

Some early prior art air bag inflators used a sodium azide/metal oxide based gas generant compositions to inflate the air bags. The sodium azide/metal oxide compositions burn at relatively cool temperatures, on the order of from about 1000° to about 1200° C., and have burn rates sufficiently fast to provide the required air bag inflation times with reasonable gas generant grain sizes and inflator operating pressures. However, those compositions also produce a large amount of unwanted solid combustion products, which, typically, account for about 60 percent of the initial weight of the composition, and include a large percentage of sodium oxide, a highly caustic and corrosive material capable of damaging lung tissues if inhaled in any significant quantity. As a result, filtration is required to remove the solid combustion products from the inflation gases. To provide a sufficiently cool gas, prior art pyrotechnic gas generators thus generally require complex filtration and heat sinking assemblies within the gas generator to remove unwanted solid combustion byproducts and heat from the gas before the gas exits the gas generator. The requirement to thoroughly filter out this toxic solid combustion product significantly adds to the cost and complexity of the filtration system within the sodium azide based air bag inflators. Moreover, sodium azide is highly toxic and hazardous to the environment, making the manufacture and the disposal of old or fired sodium azide based inflators costly and hazardous.

More recent prior art pyrotechnic air bag inflators use pyrotechnic gas generant compositions that are more environmentally friendly than sodium azide based compositions. However, to achieve the same performance as the original sodium azide based inflators in prior art "non-azide" based gas generants generally requires a higher flame temperature than that of the original sodium azide based compositions, requiring additional heat sinking. Cooler burning non-azide based formulations are available, but typically have lower burning rates than azide formulations, and produce high levels of unwanted solid products of combustion, such that complex filtration is required. The prior art non-azide based gas generant formulations also tend to produce higher levels of toxic compounds in their effluent gases, such as, e.g., carbon monoxide, oxides of nitrogen, and hydrogen cyanide.

Hybrid inflators have been developed to mitigate the limitations of the newer non-azide based formulations. Hybrid inflators use a pressurized gas that is heated by a pyrotechnic gas generant to inflate the air-bag. The pressurized gas reduces the amount of gas generant required for the application, and provides additional cool gas to mix with the hotter gases provided by the gas generant composition, thus resulting in an overall lowering of the gas temperature. The pyrotechnic gas generant composition provides energy to the gas, allowing the inflator to meet weight and size requirements that cannot be met by compressed gas sources alone. Hybrid gas generators meet the gas temperature and particulate requirements of the air bag inflators at a lower cost than the first generation sodium azide based gas generators. However, hybrid inflators are more complex, and may be less reliable due to the use of pressurized gas. A purely pyrotechnic gas generator using a pyrotechnic composition that meets the performance, gas temperature, and toxicity requirements would be less expensive, less complex, and more reliable. However, a gas generant meeting all the air bag inflator requirements does not exist in the prior art.

A number of prior art second generation air bag gas generators use 5-amino tetrazole as a primary fuel in non-azide based gas generants. Most second generation gas generants provide adequate burn rates and operating pressures, but have flame temperatures as high as from about 2500° to about 3000° C. without the use of a coolant. For example, U.S. Pat. No. 5,035,757 to Poole discloses strontium nitrate as the primary oxidizer for a 5-amino tetrazole fuel in second generation gas generants. This composition is typically stoichiometric in oxidizer/fuel balance to minimize the formation of carbon monoxide and oxides of nitrogen, such as NO, $NO_2$, and $N_2O$, and has a number of desirable characteristics. In particular, with reasonably sized gas generant grains, it ignites easily and burns fast enough to allow for low operation pressures, i.e., from about 1000 to about 3000 psi. It also produces a relatively low volume of solids upon combustion, i.e., about 0.08 cubic centimeters of theoretical solid volume per gram of gas generant combusted, and uses relatively inexpensive ingredients.

However, the adiabatic flame temperature of a stoichiometric mixture of strontium nitrate and 5-amino tetrazole is about 2700° C., when calculated using the thermochemical equilibrium combustion code PEPCODE, a commercially available computer program that calculates flame temperatures based upon the components of a composition. Such a flame temperature is about 1600° C. higher than typical first generation sodium azide formulations. As a result, a substantial increase in the amount of heat sinking or the addition of a coolant is required to bring the gas temperature into a manageable range. Heat sinking increases the volume, weight, and cost of the gas generator, and tends to increase the gas toxicity above acceptable levels. The increase in toxicity is due, at least in part, to catalytic interactions between the hot heat sink surface and the gases, forming toxic species, such as oxides of nitrogen and hydrogen cyanide. In addition, the amount of heat sinking required to provide a decrease in temperature of over 1000° C. in the gas results in a significant increase in the temperature of the device after firing because of the energy absorbed by the heat sink. As a result, there is a significant burn risk to the occupants of a vehicle equipped with such an inflator.

Prior art coolants can add significant quantities of solids to gas generant combustion effluents, requiring additional filtration and, thus, additional unit cost and complexity. Coolants also tend to significantly reduce the burn rate of the gas generant composition when used in quantities sufficient to provide useful cooling of the flame, increasing operating pressure requirements, and decreasing gas generant grain sizes both of which add to unit cost. Some examples of typical coolants used are metal carbonates and bicarbonates, such as, e.g., sodium carbonate, sodium bicarbonate, potassium carbonate, potassium bicarbonate, magnesium carbonate, and calcium carbonate, and metal oxides, such as, e.g., aluminum oxide, magnesium oxide, zinc oxide, and iron oxide.

For example, U.S. Pat. No. 6,051,158 to Taylor et al. discloses a chemical coolant formulation for use with air bag inflators. The formulation includes a "first coolant ingredient" that endothermically decomposes when contacted by a hot gas to form a cooling gas and a solid slag component. Disclosed coolants include metal carbonates, metal hydroxide, and hydrated metal salts. Disclosed hydrated metal salts are limited to $MgSO_4.7H_2O$ and $MgCl_2.6H_2O$. However, for use in an inflator, the slag component requires extensive filtering of the generated gas.

U.S. Pat. Nos. 5,735,118 and 6,039,820 to Hinshaw et al. disclose the use of alkaline earth metal and transition metal complexes as gas generating compositions. The disclosed compositions comprise a metal cation and a neutral ligand containing hydrogen and nitrogen with one or more oxidizing anions to balance the charge of the complex. The preferred neutral ligands are ammonia, substituted ammonia ligands, such as hydrazine, and substituted hydrazine ligands. Optionally, burn rate enhancers, slag formers, and coolants such as magnesium hydroxide, cupric oxalate, boric acid, aluminum hydroxide, and silicotungstic acid, may be used. As the complexes produce a significant amount of slag during combustion, gas filtration is required.

U.S. Pat. No. 3,806,461 to Hendrickson et al. discloses gas generating compositions comprising a mixture of potassium perchlorate, cupric oxalate and a relatively small amount of a polymeric fuel binder to provide a relatively cool gas. The patent discloses that, when heated, cupric oxalate decomposes exothermically to produce copper, cuprous oxide, carbon dioxide, and carbon monoxide, providing the driving force that results in a relatively high burning rate. The potassium perchlorate is used to burn the polymeric fuel binder, and to remove carbon monoxide by oxidizing that toxic gas to carbon dixoide. However, although the decomposition of cupric oxalate produces a cool gas, the decomposition of cupric oxalate is actually endothermic, and cupric oxalate alone does not provide the energetic output typically available from pyrotechnic compositions.

U.S. Pat. Nos. 5,542,998 and 5,542,999 to Bucerius et al. disclose gas generating mixtures for rescue and air bag systems, as well as rocket and tubular weapon drive systems. The mixtures contain high nitrogen, low carbon fuels of GZT, TAGN, NG, and NTO, a catalyst for reducing pollutant gases, and an oxidizer of basic copper nitrate, $Cu(NO_3)_2.3Cu(OH)_2$, and optionally, $Fe_2O_3$ as a coolant to provide a cold, rapid combustion and a high gas output.

U.S. Pat. No. 5,608,183 to Barnes et al. discloses gas generant compositions containing a nitrate salt of a polyamine or an alkyl-diamine as a fuel and basic copper nitrate and/or cobalt triamine nitrate as an oxidizer. Disclosed fuels include nitrate salts of urea, guanidine, aminoguanidine, diaminoguanidine, semicarbizide, ethylene diamine, 1,3-propane diamine, and 1,2-propane diamine. The compositions produce at least 2 moles of gas per 100 grams of generant, and burn at a temperature of no more than about 2000° C.

European Patent Publication No. EP 0 949 225 to Roedig et al. discloses azide-free gas generating compositions containing a fuel mixture and an oxidant mixture. The fuel mixture contains a guanidine compound, a heterocyclic organic acid, and, optionally, an additional fuel. The oxidizer mixture contains at least one transition metal oxide, basic copper nitrate, and a metal perchlorate, ammonium perchlorate, an alkali metal nitrate, and/or an alkaline earth metal nitrate.

International Patent Publication No. WO 99/31029 of Fonblanc et al. discloses pyrotechnic gas generating mixtures consisting essentially of an epoxy or silicone resin based cross-linkable reducing binder, an oxidizer of ammonium perchlorate and a sodium nitrate chlorine scavenger, and energetic additives consisting of a cupric compound, i.e., cupric oxide and basic copper nitrate, and a nitrogenated organic compound, i.e., nitroguanidine and guanidine nitrate. The disclosed mixtures are said to burn at moderate temperatures, generating nitrogen rich gases that are "poor" in nitrogen oxides and carbon monoxide.

U.S. Pat. No. 5,882,036 to Moore et al. discloses a hybrid inflator using a gas generant of basic copper nitrate, hexamine cobalt nitrate, guanidine nitrate, and guar gum.

U.S. Pat. No. 5,989,367 to Zeuner et al. discloses azide-free gas generating mixtures of an oxidizer of ammonium nitrate and ammonium perchlorate, an energy rich fuel of guanidine nitrate, nitroguanidine, triaminoguanidine, urea nitrate, nitrourea, pentaerythritol, tetranitrate, nitrotriazalone, hexogen, octogen, and mixtures thereof, and a combustion modifier of a transition metal oxide, hydroxide, nitrate, carbonate, or organo-metallic compound. Disclosed combustion modifiers include basic copper nitrate.

U.S. Pat. No. 6,077,372 to Mendenhall et al. discloses ignition enhanced gas generant materials in which an ignition composition is combined with a solvent and applied to a gas generant material. Disclosed ignitor composition fuels include aluminum, boron, and magnesium. Disclosed ignitor material oxidizers include alkali metal and alkaline earth metal nitrates, chlorates, and perchlorates, ammonium nitrate, ammonium perchlorate, and basic copper nitrate. The gas generant materials to which the ignition composition is applied include those containing nitrogen-containing organic compounds or tetrazole complexes as fuels, such as guanidine nitrate, aminoguanidine nitrate, triaminoguanidine nitrate, nitroguanidine, dicyandiamide, triazalone, nitrotriazalone, tetrazoles, and tetrazole complexes of copper, cobalt, and zinc. Oxidizers for the disclosed gas generant materials include ammonium nitrate and basic copper nitrate. The patent also discloses the use of a metal, as an additional fuel, and a metal oxide as a burn rate enhancer and slag producer.

Therefore, a need exists for an energetic, pyrotechnic gas generating composition that generates cool, non-toxic gases on combustion with the production of low levels of solids. The present invention provides such a composition.

SUMMARY OF THE INVENTION

The invention is directed to a low-solids gas generating composition having a relatively low flame temperature and to a method of generating a gas with low solids. The compositions of the invention comprise a mixture of a basic copper nitrate oxidizer and a fuel selected for the group consisting of 5-nitro-uracil, guanidine 5-nitro-uracil salt, ammonium 5-nitro-uracil salt, aminoguanidine 5-nitro-uracil salt, hydrazine 5-nitro-uracil salt, triamino 5-nitro-uracil salt, guanidine 5-nitro-barbituric acid salt, ammonium 5-nitro-barbituric acid salt, hydrazine 5-nitro-barbituric acid salt, aminoguanidine 5-nitro-barbituric acid salt, triaminoguanidine 5-nitro-barbituric acid salt, and mixtures thereof, wherein the oxidizer-fuel mixture is within about 4 percent of stoichiometric balance, and produces no more than about 0.06 cubic centimeters of solids per gram of gas generating composition on combustion. The compositions of the invention may further comprise at least one of cupric oxalate hemi-hydrate as a coolant, sub-micron fumed silica, and graphite. Preferably, the gas generant is in the form of pressed pellets, grains, or granules.

Preferred gas generating compositions in accordance with the invention include the following:

Mixtures comprising 5-nitro-uracil, basic copper nitrate, and, optionally, fumed silica, where the mixture preferably comprises from about 17.2 to about 39.3 percent 5-nitro-uracil, from about 82 to about 60.1 percent basic copper nitrate, and up to about 0.8 percent, preferably from about 0.8 to about 0.6 percent, fumed silica;

Mixtures comprising 5-nitro-uracil, basic copper nitrate, and, optionally, fumed silica and/or anhydrous activated $Al_2O_3$, where the mixture preferably comprises from about 16.5 to about 37.7 percent 5-nitro-uracil, from about 78.7 to about 57.7 percent basic copper nitrate, up to about 0.8 percent, preferably from about 0.8 to about 0.6 percent, fumed silica, and up to about 4 percent anhydrous activated $Al_2O_3$;

Mixtures comprising guanidine 5-nitro-uracil salt, basic copper nitrate, and, optionally, fumed silica, where the mixture preferably comprises from about 13.6 to about 32.3 percent guanidine 5-nitro-uracil salt, from about 84.7 to about 66.4 percent basic copper nitrate, and up to about 1.7 percent, preferably from about 1.7 to about 1.3 percent, fumed silica;

Mixtures comprising ammonium 5-nitro-uracil salt, basic copper nitrate, and, optionally, fumed silica, where the mixture preferably comprises from about 15.3 to about 35.6 percent ammonium 5-nitro-uracil salt, from about 83 to about 63 percent basic copper nitrate, and up to about 1.7 percent, preferably from about 1.7 to about 1.3 percent, fumed silica;

Mixtures comprising aminoguanidine 5-nitro-uracil salt, basic copper nitrate, and, optionally, fumed silica, where the mixture preferably comprises from about 22.8 to about 32.7 percent aminoguanidine 5-nitro-uracil salt, from about 75.7 to about 66 percent basic copper nitrate, and up to about 1.5 percent, preferably from about 1.5 to about 1.3 percent, fumed silica;

Mixtures comprising hydrazine 5-nitro-uracil salt, basic copper nitrate, and, optionally, fumed silica, where the mixture preferably comprises from about 15.5 to about 36 percent hydrazine 5-nitro-uracil salt, from about 82.8 to about 62.7 percent basic copper nitrate, and up to about 1.7 percent, preferably from about 1.7 to about 1.3 percent, fumed silica;

Mixtures comprising triaminoguanidine 5-nitro-uracil salt, basic copper nitrate, and, optionally, fumed silica, where the mixture preferably comprises from about 14.2 to about 33.4 percent triaminoguanidine 5-nitro-uracil salt, from about 84.4 to about 65.3 percent basic copper nitrate, and up to about 1.7 percent, preferably from about 1.7 to about 1.3 percent, fumed silica;

Mixtures comprising guanidine 5-nitro-barbituric acid salt, basic copper nitrate, and, optionally, fumed silica, where the mixture preferably comprises from about 15.7 to about 36.5 percent guanidine 5-nitro-barbituric acid salt, from about 82.6 to about 62.3 percent basic copper nitrate, and up to about 1.7 percent, preferably from about 1.7 to about 1.2 percent, fumed silica;

Mixtures comprising ammonium 5-nitro-barbituric acid salt, basic copper nitrate, and, optionally, fumed silica, where the mixture preferably comprises from about 18.4 to about 41.8 percent ammonium 5-nitro-barbituric acid salt, from about 80 to about 57 percent basic copper nitrate, and up to about 1.6 percent, preferably from about 1.6 to about 1.2 percent, fumed silica;

Mixtures comprising hydrazine 5-nitro-barbituric acid salt, basic copper nitrate, and, optionally, fumed silica, where the mixture preferably comprises from about 18.4 to about 41.7 percent hydrazine nitro-barbituric acid salt, from about 80 to about 57.2 percent basic copper nitrate, and up to about 1.6 percent, preferably from about 1.6 to about 1.1 percent, fumed silica;

Mixtures comprising aminoguanidine 5-nitro-barbituric acid salt, basic copper nitrate, and, optionally, fumed silica, where the mixture preferably comprises from about 15.8 to about 36.7 percent aminoguanidine 5-nitro-barbituric acid salt, from about 82.5 to about 62.1 percent basic copper nitrate, and up to about 1.7 percent, preferably from about 1.7 to about 1.2 percent, fumed silica;

Mixtures comprising triaminoguanidine 5-nitro-barbituric acid salt, basic copper nitrate, and, optionally, fumed silica, where the mixture preferably comprises from about 16 to about 37.1 percent triaminoguanidine 5-nitro-barbituric acid salt, from about 82.4 to about 61.7 percent basic copper nitrate, and up to about 1.6 percent, preferably from about 1.6 to about 1.2 percent, fumed silica;

Mixtures comprising basic copper nitrate, cupric oxalate hemi-hydrate, and, optionally, 5-nitro-uracil, where the mixture preferably comprises from about 50 to about 27.9 percent basic copper nitrate, about 50 percent cupric oxalate hemi-hydrate, and up to about 22.1 percent 5-nitro-uracil;

Mixtures comprising basic copper nitrate, cupric oxalate hemi-hydrate, and, optionally, guanidine 5-nitro-uracil salt, where the mixture preferably comprises from about 50 to about 31.7 percent basic copper nitrate, about 50 percent cupric oxalate hemi-hydrate, and up to about 18.3 percent guanidine 5-nitro-uracil salt; and Mixtures comprising basic copper nitrate, guanidine nitrate, 5-nitro-uracil, cupric oxalate hemi-hydrate, graphite, and, optionally, fumed silica, where the mixture preferably comprises about 40.4 percent basic copper nitrate, about 6.6 percent guanidine nitrate, about 18.6 percent 5-nitro-uracil, about 33.3 percent cupric oxalate hemi-hydrate, about 0.3 percent graphite, and about 0.8 percent fumed silica.

The method of the invention comprises preparing a mixture comprising a basic copper nitrate oxidizer, a fuel selected from the group consisting of 5-nitro-uracil, guanidine 5-nitro-uracil salt, ammonium 5-nitro-uracil salt, aminoguanidine 5-nitro-uracil salt, hydrazine 5-nitro-uracil salt, triamino 5-nitro-uracil salt, guanidine 5-nitro-barbituric acid salt, ammonium 5-nitro-barbituric acid salt, hydrazine 5-nitro-barbituric acid salt, aminoguanidine 5-nitro-barbituric acid salt, triaminoguanidine 5-nitro-barbituric acid salt, and mixtures thereof, and, optionally, at least one of cupric oxalate hemi-hydrate as a coolant, sub-micron fumed silica, and graphite, wherein the oxidizer-fuel mixture is within about 4 percent of stoichiometric balance; combusting the mixture, thereby producing a gas and no more than about 0.06 cubic centimeters of solids per gram of gas generating composition on combustion.

DETAILED DESCRIPTION OF PREFERRED EMBODIMENTS OF INVENTION

Unless otherwise stated, all references to "percent" or "%" refer to percent by weight based on the total weight of the composition.

As used herein, the term "stoichiometric balance" means that the ratio of oxidizer to fuel is such that upon combustion of the composition all of the fuel is fully oxidized, and no excess of oxygen is produced. A "near stoichiometric balance" is one in which the ratio of oxygen mass surplus or deficit to total mixture mass is within about four percent of a stoichiometric balance.

As used herein, the terms "low solids" and "low levels of solids" mean that, upon combustion, the gas generant produces substantially lower solids than the 60 percent solids produced on combustion by gas generants used in prior art pyrotechnic inflators, such as sodium azide based inflators. The gas generants of the invention typically produce less than about 60 percent solids, and preferably less than about 0.06 cubic centimeters of solids per gram of gas generant. This is advantageous in that it minimizes or eliminates the need for a filter in the inflator, thus, simplifying inflator design.

All flame temperatures referred to herein are adiabatic flame temperatures calculated with the thermochemical equilibrium combustion code PEPCODE.

The present invention is directed to low solids, high gas producing gas generant compositions that produce essentially non-toxic gases upon combustion. The compositions of the invention comprise a primary fuel and primary oxidizer, and may further include additives, such as, e.g., burn rate catalysts, coolants, anti-oxidants, and manufacturing aides. The compositions of the invention produce a low volume of solids upon combustion, and, thus, when used in a gas generator, the gas generator requires little or no filtration.

The flame temperatures of the gas generant compositions of the invention are generally below about 2000° C., and preferably, below about 1600° C. Most non-azide gas generants that meet both the performance requirements for burn rate, operating pressure, toxicity, and low volume of unwanted solid combustion byproducts have adiabatic flame temperatures that are generally greater than about 2000° C. With the present invention, flame temperatures below 1000° C. may be obtained in gas generants that support continuous combustion at ambient temperature and pressure, which is a highly desirable feature in certain applications, such as, e.g., in the inflation of devices which require sustained pressurization, but do not require extremely fast inflation, such as life rafts, other such buoyancy devices, and emergency slides for air planes. A gas generating composition that can burn at ambient allows for very simple, light weight containers to be used for the gas generator case, providing gas generators having masses and volumes less than half that of an equivalent pressurized gas system.

The primary oxidizer in the preferred embodiments is basic copper nitrate, $Cu_4(OH)_6(NO_3)_2$, which is a unique oxidizer. Basic copper nitrate produces a very low volume of solids upon combustion, about 53 weight percent copper, based on the total original weight of basic copper nitrate when combusted in a gas generant with a fuel to oxidizer balance that is near stoichiometric. For example, basic copper nitrate, when thermally decomposed in an inert atmosphere to pure copper, will leave 53 percent by weight copper metal residue. The copper produced during combustion is very easy to trap within a gas generator due to its relatively high density of 8.9 grams per cubic centimeter. Generally, because of the flame temperature, the copper is in the liquid state in the gas generator due to its low melting point of 1083° C., which further simplifies trapping, as the liquid tends to slag and plate out on cool surfaces inside the gas generator more easily than solids or gases. As a result, no separation or filtration above and beyond that provided by the interior walls of the combustion chamber is generally required because the copper "slags" up in the combustion chamber forming a "clinker". Any remaining copper in the gas stream generally separates due to the forces acting on the copper as the gas turns and weaves through the combustion chamber making its way to the exit orifices of the device. The residual copper simply separates out because of its high density relative to the gases, and plates out on the inside walls of the gas generator. Compared to other oxidizers, basic copper nitrate forms relatively cool burning gas generant compositions, which is highly desirable in applications such as inflatable devices, where high temperature gases can damage the inflatable device material.

In the present invention, the primary fuel is selected to minimize the volume of solids produced upon combustion, and should be selected and balanced in proportions sufficient to provide a low level of gas toxicity. U.S. Pat. No. 5,780,768 to Knowlton, et al, the teachings of which are incorporated herein by reference to the extent necessary to supplement this specification, provides a good description of how to balance the fuel and oxidizer amounts in the composition to minimize gas toxicity. The constituents of the composition are selected to produce an output gas consisting essentially of carbon dioxide, nitrogen, water, and oxygen. Any halogens or sulfur contained in the composition should have an equimolar or greater amount of a corresponding alkali metal salt in the composition to remove any halogen or sulfur compounds produced during combustion by forming the corresponding alkali metal halogen or sulfur containing salt, which may then be separated as a solid. For example sodium nitrate or sodium carbonate in the original composition will be converted to sodium chloride or sodium sulfide or sulfate in a solid form, which is then separated from the generated gases. Again, this is described in detail in U.S. Pat. No. 5,780,768. The oxygen balance, i.e., the ratio of oxidizer to fuel in the composition should be within about four percent of stoichiometric balance as described in U.S. Pat. No. 5,780,768. Basic copper nitrate is preferably combusted to form copper, but may be combusted in the presence of excess oxidizer to form cuprous oxide and/or cupric oxide or a combination copper and cuprous oxide and/or cupric oxide. In the case of excess oxidizer, the limit of within about four percent of stoichiometric balance applies to that above and beyond what is required to combust all of the copper to cuprous or cupric oxide. That is, sufficient oxidizer must be added to burn all the carbon to $CO_2$, all of the hydrogen to $H_2O$, and all the copper to CuO before counting the excess oxidizer toward the four percent of stoichiometric balance limit.

For a mixture comprising, for example, 5-nitro-uracil and basic copper nitrate amounts of each component required to obtain an oxygen balance of plus or minus four percent of stoichiometric are determined as follows:

The amount of oxygen required to oxidize one gram of 5-nitro-uracil stoichiometrically, forming carbon dioxide, nitrogen and water, is 0.5605 grams, which corresponds to 5.5 moles of oxygen per mole of 5-nitro-uracil, $C_4N_3H_3O_4$.

Upon decomposition to copper, basic copper nitrate produces about 0.3 grams of oxygen per gram of basic copper nitrate, which corresponds to 9 moles of atomic oxygen per mole of basic copper nitrate, $Cu_4(OH)_6(NO_3)_2$. On decomposition and oxidation to copper oxide, basic copper nitrate produces about 0.167 grams of atomic oxygen per gram of basic copper nitrate, which corresponds to about 5 moles of oxygen per mole of basic copper oxide.

The lower limit for an oxygen balance of minus four percent with respect to stoichiometric is calculated using the value of 0.3 for the oxygen produced by basic copper nitrate decomposed to copper. In the following equations, 5NU represents 5-nitro-uracil, and BCN represents basic copper nitrate.

$$\text{Mass fraction of BCN}\times 0.3-\text{Mass fraction of 5NU}\times 0.5605=-0.04,$$

where the mass fraction of BCN=1−mass fraction of 5NU. Therefore, $$(1-\text{Mass fraction of 5NU})\times 0.3-\text{mass fraction of 5NU}\times 0.5605=-0.04$$

Solving those two equations yields composition mass percentages of about 39.5 percent 5-nitro-uracil and 60.5 percent basic copper nitrate for a composition having an oxygen balance of four weight percent less than the stoichiometric balance.

The upper limit of an oxygen balance of plus four percent with respect to stoichiometric is calculated using the value of 0.1667 grams of oxygen produced by the decomposition of one gram of basic copper nitrate to copper oxide.

$$\text{Mass fraction of BCN}\times 0.1667-\text{mass fraction of 5NU}\times 0.5605=+0.04,$$

Where the mass fraction of BCN=1−Mass fraction of 5NU. Therefore, $$(1-\text{mass fraction 5NU})\times 0.1667-\text{mass fraction 5NU}\times 0.5605=+0.04.$$

Solving those two equations yields compositions having mass percentages of about 17.4 mass percent 5-nitro-uracil and 82.6 mass percent basic copper nitrate for a composition having an oxygen balance of four weight percent greater than the stoichiometric balance.

As an oxidizer, basic copper nitrate is stable when used in gas generant formulations with other compatible materials, but will react with acidic materials and with materials that are strong Lewis bases, such as compounds containing nitrogen with available free electron pairs, including, e.g., organic amines, hydrazides, azides, and imines. Acidic materials react with the copper hydroxide contained in the basic copper nitrate, and attack the basic copper hydroxide, forming the copper salt of the acid and water. Strong Lewis bases tend to act as ligands, attaching to the copper cation of the copper nitrate molecules in the basic copper nitrate crystal, which displaces copper hydroxide from the crystal structure. When displaced from the crystal structure, the copper hydroxide typically decomposes into cupric oxide and water. In each case, the water weakens the gas generant grains, causing the grains to lose structural integrity. Additionally, basic copper nitrate will decompose to copper oxide and nitric acid in the presence of a sufficiently large quantity of hot water. As a result, reaction with either a strong Lewis acid or a strong Lewis base will result in additional decomposition of the remaining basic copper nitrate in the presence of heat, making the list of available ingredients that are compatible with basic copper nitrate significantly shorter than the that for other oxidizers. Thus, the selection of fuels and additives for use in gas generant compositions containing basic copper nitrate as the oxidizer must be made carefully.

The following non-limiting examples are merely illustrative of the preferred embodiments of the present invention, and are not to be construed as limiting the invention, the scope of which is defined by the appended claims. All percentages are given in weight or mass percent.

EXAMPLES

Example 1

5-nitro-uracil 34.4%

Basic Copper Nitrate 64.9%

Cabosil 0.7%

This composition provides an adiabatic flame temperature of 1673° C., and generates about 2.1 moles of gas per 100 grams of gas generant combusted. The solid byproducts of combustion are principally composed of about 34 percent copper and about 0.7 percent silicon dioxide, based on the total weight of the gas generant composition, for a total of about 0.043 cc of solids per gram of gas generant.

The formulation of example 1 ages and performs well in certain applications when used in powdered form, meeting air bag environmental requirements. However, when used in tablet form in a sealed inflator and aged at 107° C. for 400 hours, it releases about one percent moisture, weakening the tablet strength, and causing operating pressures to increase about two fold after aging. The release of water is due to the mildly acidic nature of 5-nitro-uracil, which has a pH of about 3 when dissolved in water to form a saturated solution. Although only mildly acidic, the acidity of 5-nitro-uracil is sufficiently high to react with the copper hydroxide molecules in the basic copper nitrate. The reaction does not occur to any significant degree when the 107° C. aging is carried out in an open container. The reaction is catalyzed by water, which solvates the 5-nitro-uracil, allowing it to migrate to the basic copper nitrate and attack it. Thus, the aging of the composition in an open environment allows the water to evaporate before reacting with the basic copper nitrate, thus preventing the reaction from proceeding to any significant degree under these conditions.

Example 2

5-nitro-uracil 33.0%

Basic Copper Nitrate 62.3%

Cabosil 0.7%

Anhydrous Activated $Al_2O_3$ 4.0%

This composition provides an adiabatic flame temperature of about 1610° C., and generates about 2.0 moles of gas per 100 grams of gas generant combusted. The solid byproducts of combustion are principally composed of about 34 percent copper and about 0.7 percent silicon dioxide, based on the total weight of the gas generant composition, for a total of about 0.053 cc of solids per gram of gas generant.

The composition of example 2 includes a desiccant to absorb any water created by the reaction between the 5-nitro-uracil and the basic copper nitrate. This absorption of water by the desiccant effectively halts the reaction by eliminating the carrier of the 5-nitro-uracil molecules. The composition ages significantly better at relatively high temperature in a sealed inflator than the composition of example 1. Desiccants other than $Al_2O_3$ may be used, such as, e.g., silica gel, other metal oxides, such as magnesium oxide, metal carbonates, such as magnesium carbonate and calcium carbonate, metal sulfates, provided sufficient alkali metal salts are added to react with the sulfur, anhydrous metal oxalates, anhydrous ammonium oxalate, and any other desiccant that scavenges water adequately, while meeting all other compatibility and performance requirements.

As an alternative to desiccants, a salt of the acidic fuel may be used to reduce the reaction with the basic copper nitrate. The cation used to form the salt is selected to make the salt neutral or mildly basic. Alkali or alkaline metal cations perform this function adequately. However, such salts burn to form the metal oxide, hydroxide, or carbonate, which can add significantly to the volume of solids produced by the gas generant. The solids typically have a relatively low density of around 2 grams per cubic centimeter, and, thus, add to the total volume of particulates produced by the gas generant composition. The solids formed from the alkali and alkaline metal salts also produce relatively caustic solid byproducts, such as alkali metal oxides and hydroxides, increasing the toxicity and hazard potential of the effluents from the gas generator. Therefore, the preferred cations are non-solid producing cations of ammonia, hydrazine, hydroxyl amine, organic amines, such as guanidine, basic organic imines, and basic organic hydrazides. The most preferred non-solid producing cations are ammonia, hydrazine, guanidine, and guanidine derivatives such as amino guanidine, diamino guanidine, and triamino guanidine. Salts of acidic fuels are prepared made by reacting the acidic fuel with the hydroxide, carbonate, or bicarbonate of the cation in aqueous solution. For example, 5-nitro-uracil reacts readily with guanidine carbonate in water to form the guanidinium salt of 5-nitro-uracil. The material is very stable thermally, and only decomposes at about 300° C.

Example 3

Guanidine 5-nitro-uracil salt 28.4%

Basic Copper Nitrate 70.2%

Cabosil 1.4%

This composition provides an adiabatic flame temperature of about 1480° C., and generates about 2.2 moles of gas per 100 grams of gas generant combusted. The solid byproducts of combustion are principally composed of about 37 percent copper and about 1.4 percent silicon dioxide, based on the total weight of the gas generant composition, for a total of about 0.049 cc of solids per gram of gas generant.

Example 4

Ammonium 5-nitro-uracil salt 31.4%

Basic Copper Nitrate 67.2%

Cabosil 1.4%

This composition provides an adiabatic flame temperature of about 1480° C., and generates about 2.2 moles of gas per 100 grams of gas generant combusted. The solid byproducts of combustion are principally composed of about 36 percent copper and about 1.4 percent silicon dioxide, based on the total weight of the gas generant composition, for a total of about 0.047 cc of solids per gram of gas generant.

Example 5

Aminoguanidine 5-nitro-uracil salt 28.8%

Basic Copper Nitrate 69.8%

Cabosil 1.4%

This composition provides an adiabatic flame temperature of about 1510° C., and generates about 2.2 moles of gas per 100 grams of gas generant combusted. The solid byproducts of combustion are principally composed of about 37 percent copper and about 1.4 percent silicon dioxide, based on the total weight of the gas generant composition, for a total of about 0.048 cc of solids per gram of gas generant.

Example 6

Hydrazine 5-nitro-uracil salt 31.7%

Basic Copper Nitrate 66.9%

Cabosil 1.4%

This composition provides an adiabatic flame temperature of about 1580° C., and generates about 2.25 moles of gas per 100 grams of gas generant combusted. The solid byproducts of combustion are principally composed of about 35 percent copper and about 1.4 percent silicon dioxide, based on the total weight of the gas generant composition, for a total of about 0.047 cc of solids per gram of gas generant.

Example 7

Triaminoguanidine 5-nitro-uracil salt 29.4%

Basic Copper Nitrate 69.2%

Cabosil 1.4%

This composition provides an adiabatic flame temperature of about 1690° C., and generates about 2.25 moles of gas per 100 grams of gas generant combusted. The solid byproducts of combustion are principally composed of about 37 percent copper and about 1.4 percent silicon dioxide, based on the total weight of the gas generant composition, for a total of about 0.048 cc of solids per gram of gas generant.

Example 8

Guanidine 5-nitro-barbituric acid salt 32.1%

Basic Copper Nitrate 66.5%

Cabosil 1.4%

This composition provides an adiabatic flame temperature of about 1240° C., and generates about 2.2 moles of gas per 100 grams of gas generant combusted. The solid byproducts of combustion are principally composed of about 35 percent copper and about 1.4 percent silicon dioxide, based on the total weight of the gas generant composition, for a total of about 0.046 cc of solids per gram of gas generant.

Example 9

Ammonium 5-nitro-barbituric acid salt 36.8%

Basic Copper Nitrate 61.9%

Cabosil 1.3%

This composition provides an adiabatic flame temperature of about 1200° C. and generates about 2.25 moles of gas per 100 grams of gas generant combusted. The solid byproducts of combustion are principally composed of about 33 percent copper and about 1.3 percent silicon dioxide, based on the total weight of the gas generant composition, for a total of about 0.043 cc of solids per gram of gas generant.

Example 10

Hydrazine 5-nitro-barbituric acid salt 36.7%

Basic Copper Nitrate 62.0%

Cabosil 1.3%

This composition provides an adiabatic flame temperature of about 1330° C., and generates about 2.3 moles of gas per 100 grams of gas generant combusted. The solid byproducts of combustion are principally composed of about 33 percent copper and about 1.3 percent silicon dioxide, based on the total weight of the gas generant composition, for a total of about 0.043 cc of solids per gram of gas generant.

Example 11

Aminoguanidine 5-nitro-barbituric acid salt 32.3%

Basic Copper Nitrate 66.3%

Cabosil 1.4%

This composition provides an adiabatic flame temperature of about 1320° C., and generates about 2.25 moles of gas per 100 grams of gas generant combusted. The solid byproducts of combustion are principally composed of about 35 percent copper and about 1.4 percent silicon dioxide, based on the total weight of the gas generant composition, for a total of about 0.046 cc of solids per gram of gas generant.

Example 12

Triaminoguanidine 5-nitro-barbituric acid salt 32.6%

Basic Copper Nitrate 66.1%

Cabosil 1.3%

This composition provides an adiabatic flame temperature of about 1530° C., and generates about 2.3 moles of gas per 100 grams of gas generant combusted. The solid byproducts of combustion are principally composed of about 35 percent copper and about 1.3 percent silicon dioxide, based on the total weight of the gas generant composition, for a total of about 0.046 cc of solids per gram of gas generant.

Example 13

Basic Copper Nitrate 32.6%

Cupric Oxalate Hemi-hydrate 50%

5-nitro-uracil 17.4%

This composition provides an adiabatic flame temperature of about 978° C., and generates about 1.85 moles of gas per 100 grams of gas generant combusted. The solid byproducts of combustion are principally composed of about 36.8 percent copper, based on the total weight of the gas generant composition, for a total of about 0.041 cc of solids per gram of gas generant.

Example 14

Basic Copper Nitrate 32.6%

Cupric Oxalate Hemi-hydrate 50%

Guanidine 5-nitro-uracil salt 17.4%

This composition provides an adiabatic flame temperature of 872° C., and generates about 1.85 moles of gas per 100 grams of gas generant combusted. The solid byproducts of combustion are principally composed of about 38.5 percent copper, based on the total weight of the gas generant composition, for a total of about 0.043 cc of solids per gram of gas generant.

Example 15

A mixture of the following formulation was made:

Basic Copper Nitrate (7 micron) 40.4%

Guanidine Nitrate (10 micron) 6.6%

5-nitro-uracil (4 micron) 18.6%

Cupric Oxalate Hemi-hydrate 33.3%

Graphite 0.3%

Cabosil 0.8%

The cupric oxalate hemi-hydrate, graphite, and cabosil were used in the "as received" particle size. The cupric oxalate hemi-hydrate was obtained from Bemardy Chemie of Theniux, France through their US distributor Ingraham and Company, of Houston, Tex. This material is about 8 micron in particle size "as received". The cabosil is sub-micron fumed silica available from Cabot Corp. of Tuscola, Ill. The graphite is Micro-Mesh-325 mesh graphite available from Superior Graphite Co. of Chicago, Ill. The basic copper nitrate was purchased from Shepherd Chemical Co. of Norwood, Ohio. The guanidine nitrate was obtained from Sigma Aldrich Fluka bulk chemicals division of Milwaukee, Wis. The 5-nitro-uracil was obtained from BF Goodrich, Pharmaceuticals Division of Raubling Germany. The cabosil was first pre-blended with the basic copper nitrate to coat the basic copper nitrate with the cabosil to aid in tablet pressing. The balance of the materials were added to the cabosil coated basic copper nitrate and blended together. The resulting blended material was pressed into a ⅜" diameter by about 1.2 inch long cylinder using about 100,000 psi to press the cylindrical burn strand. The strand was ignited with a nichrome wire, and allowed to burn to completion at ambient temperature and pressure. The average burn rate was about 0.058 inches per second. The strand burned in a cigarette-like fashion leaving the solid residue of combustion attached to the burn strand as it combusted. The strand burned with no apparent gaseous flame. The theoretical adiabatic flame temperature of this composition is 1134° C., and the volume of solids produced is about 0.043 cubic centimeters per gram.

Example 16

A mixture of the following formulation was made:

Basic Copper Nitrate (7 micron) 30.3%

Guanidine Nitrate (10 micron) 4.9%

5-nitro-uracil (4 micron) 14.0%

Cupric Oxalate Hemi-hydrate 50%

Graphite 0.2%

Cabosil 0.6%

The cupric oxalate hemi-hydrate, graphite, and cabosil were used in the "as received" particle size. All materials were obtained from the same sources as those provided in example 15. The blending was performed as described in example 15. The resulting blended material was pressed into a ⅜" diameter by about 1.2 inch long cylinder using about 100,000 psi to press the cylindrical burn strand. The strand was ignited with a nichrome wire and allowed to burn to completion at ambient temperature and pressure. The average burn rate was about 0.031 inches per second. The strand burned in a cigarette-like fashion leaving the solid residue of combustion attached to the burn strand as it combusted. The strand burned with no apparent gaseous flame. The theoretical adiabatic flame temperature of this composition is 939° C., and the volume of solids produced is about 0.043 cubic centimeters per gram.

Example 17

The mixture of example 3 was pressed into tablets averaging about 0.19 inches diameter and about 0.06 inches in thickness. The blended material was first slugged into 1⅛ inch diameter by about 0.1 to about 0.3 inch thick slugs using a Stokes model R tablet press at about 60,000 psi. The slugs were granulated with a 16 mesh granulation screen on a Stokes granulator. These granules were sieved with a 60 mesh screen to remove any fine, i.e., less than 60 mesh, granules or powder, and the remaining +60 mesh granules were coated with one percent by mass graphite to prevent any sticking during tablet pressing. The tablets were pressed on a Stokes model T press to the final tablet dimensions averaging about 0.19 inches diameter by 0.06 inches thickness. The press was adjusted until the resulting tablet was very hard with a glossy surface and difficult to break. Based on the prior pressing of burn strands, the press force during this operation was about 100,000 psi at the tablet. A load of 50 grams of the tablets was loaded into a discoidal driver side type inflator about 60 mm in diameter and about 35 mm tall. The inflator used a automotive initiator by Special Devices Incorporated of Moore Park, Calif. to initiate the gas generant tablets. The initiator had a load of 300 milligrams of titanium hydride potassium perchlorate. The inflator had two sharp edged exhaust nozzles with a diameter of about 0.125 inches each. Each exhaust nozzle was sealed on the inside of the inflator with a piece of pressure sensitive one ounce copper foil tape, 0.0014 inch thick copper backed by 0.002 inch thick acrylic pressure sensitive adhesive. The tape acted as an environmental seal and as a burst disc during the initial inflator pressurization at firing. The inflator was fired into a sealed 60 liter tank, which was at ambient pressure and temperature prior to firing. A peak pressure of 240 kilopascals developed in 60 milliseconds.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

What is claimed is:

1. A low-solids gas generating composition, comprising a mixture of a basic copper nitrate oxidizer, a fuel selected for the group consisting of 5-nitro-uracil, guanidine 5-nitro-uracil salt, ammonium 5-nitro-uracil salt, aminoguanidine 5-nitro-uracil salt, hydrazine 5-nitro-uracil salt, triamino 5-nitro-uracil salt, guanidine 5-nitro-barbituric acid salt, ammonium 5-nitro-barbituric acid salt, hydrazine 5-nitro-barbituric acid salt, aminoguanidine 5-nitro-barbituric acid salt, triaminoguanidine 5-nitro-barbituric acid salt, and mixtures thereof, and sub-micron fumed silica, wherein the oxidizer-fuel mixture is within about 4 percent of stoichiometric balance, and produces no more than about 0.06 cubic centimeters of solids per gram of gas generating composition on combustion.

2. The gas generating composition of claim 1, further comprising graphite.

3. The gas generating composition of claim 1, further comprising cupric oxalate hemi-hydrate.

4. The gas generating composition of claim 1, wherein the gas generant is in the form of pressed pellets, grains, or granules.

5. The gas generating composition of claim 1, comprising 5-nitro-uracil, basic copper nitrate, and fumed silica.

6. The gas generating composition of claim 5, comprising from about 17.2 to about 39.3 percent 5-nitro-uracil, from about 82 to about 60.1 percent basic copper nitrate, and up to about 0.8 percent fumed silica.

7. The gas generating composition of claim 1, comprising 5-nitro-uracil, basic copper nitrate, fumed silica, and anhydrous activated $Al_2O_3$.

8. The gas generating composition of claim 7, comprising from about 16.5 to about 37.7 percent 5-nitro-uracil, from about 78.7 to about 57.7 percent basic copper nitrate, up to about 0.8 percent fumed silica, and up to about 4 percent anhydrous activated $Al_2O_3$.

9. The gas generating composition of claim 1, comprising guanidine 5-nitro-uracil salt, basic copper nitrate and fumed silica.

10. The gas generating composition of claim 9, comprising from about 13.6 to about 32.3 percent guanidine 5-nitro-uracil salt, from about 84.7 to about 66.4 percent basic copper nitrate, and up to about 1.7 percent fumed silica.

11. The gas generating composition of claim 1, comprising ammonium 5-nitro-uracil salt, basic copper nitrate and fumed silica.

12. The gas generating composition of claim 11, comprising from about 15.3 to about 35.6 percent ammonium 5-nitro-uracil salt, from about 83 to about 63 percent basic copper nitrate, and up to about 1.7 percent fumed silica.

13. The gas generating composition of claim 1, comprising aminoguanidine 5-nitro-uracil salt, basic copper nitrate and fumed silica.

14. The gas generating composition of claim 13, comprising from about 22.8 to about 32.7 percent aminoguanidine 5-nitro-uracil salt, from about 75.7 to about 66 percent basic copper nitrate, and up to about 1.5 percent fumed silica.

15. The gas generating composition of claim 1, comprising hydrazine 5-nitro-uracil salt, basic copper nitrate and fumed silica.

16. The gas generating composition of claim 15, comprising from about 15.5 to about 36 percent hydrazine 5-nitro-uracil salt, from about 82.8 to about 62.7 percent basic copper nitrate, and up to about 1.7 percent fumed silica.

17. The gas generating composition of claim 1, comprising triaminoguanidine 5-nitro-uracil salt, basic copper nitrate and fumed silica.

18. The gas generating composition of claim 17, comprising from about 14.2 to about 33.4 percent triaminoguanidine 5-nitro-uracil salt, from about 84.4 to about 65.3 percent basic copper nitrate, and up to about 1.7 percent fumed silica.

19. The gas generating composition of claim 1, comprising guanidine 5-nitro-barbituric acid salt, basic copper nitrate, and fumed silica.

20. The gas generating composition of claim 19, comprising from about 15.7 to about 36.5 percent guanidine 5-nitro-barbituric acid salt, from about 82.6 to about 62.3 percent basic copper nitrate, and up to about 1.7 percent fumed silica.

21. The gas generating composition of claim 1, comprising ammonium 5-nitro-barbituric acid salt, basic copper nitrate and fumed silica.

22. The gas generating composition of claim 21, comprising from about 18.4 to about 41.8 percent ammonium 5-nitro-barbituric acid salt, from about 80 to about 57 percent basic copper nitrate, and up to about 1.6 percent fumed silica.

23. The gas generating composition of claim 1, comprising hydrazine 5-nitro-barbituric acid salt, basic copper nitrate and fumed silica.

24. The gas generating composition of claim 23, comprising from about 18.4 to about 41.7 percent hydrazine nitro-barbituric acid salt, from about 80 to about 57.2 percent basic copper nitrate, and up to about 1.6 percent fumed silica.

25. The gas generating composition of claim 1, comprising aminoguanidine 5-nitro-barbituric acid salt, basic copper nitrate and fumed silica.

26. The gas generating composition of claim 25, comprising from about 15.8 to about 36.7 percent aminoguanidine 5-nitro-barbituric acid salt, from about 82.5 to about 62.1 percent basic copper nitrate, and up to about 1.7 percent fumed silica.

27. The gas generating composition of claim 1, comprising triaminoguanidine 5-nitro-barbituric acid salt, basic copper nitrate and fumed silica.

28. The gas generating composition of claim 27, comprising from about 16 to about 37.1 percent triaminoguanidine 5-nitro-barbituric acid salt, from about 82.4 to about 61.7 percent basic copper nitrate, and up to about 1.6 percent fumed silica.

29. The gas generating composition of claim 1, comprising basic copper nitrate, cupric oxalate hemi-hydrate, 5-nitro-uracil, and fumed silica.

30. The gas generating composition of claim 29, comprising from about 50 to about 27.9 percent basic copper nitrate, about 50 percent cupric oxalate hemi-hydrate, and up to about 22.1 percent 5-nitro-uracil.

31. The gas generating composition of claim 1, comprising basic copper nitrate, cupric oxalate hemi-hydrate, guanidine 5-nitro-uracil salt, and fumed silica.

32. The gas generating composition of claim 31, comprising from about 50 to about 31.7 percent basic copper nitrate, about 50 percent cupric oxalate hemi-hydrate, and up to about 18.3 percent guanidine 5-nitro-uracil salt.

33. The gas generating composition of claim 1, comprising basic copper nitrate, guanidine nitrate, 5-nitro-uracil, cupric oxalate hemi-hydrate, graphite and fumed silica.

34. The gas generating composition of claim 1, comprising about 40.4 percent basic copper nitrate, about 6.6 percent guanidine nitrate, about 18.6 percent 5-nitro-uracil, about 33.3 percent cupric oxalate hemi-hydrate, about 0.3 percent graphite, and about 0.8 percent fumed silica.

35. A method of generating a gas with low-solids, the method comprising:

preparing a mixture comprising a basic copper nitrate oxidizer, a fuel selected for the group consisting of 5-nitro-uracil, guanidine 5-nitro-uracil salt, ammonium 5-nitro-uracil salt, aminoguanidine 5-nitro-uracil salt, hydrazine 5-nitro-uracil salt, triamino 5-nitro-uracil salt, guanidine 5-nitro-barbituric acid salt, ammonium 5-nitro-barbituric acid salt, hydrazine 5-nitro-barbituric acid salt, aminoguanidine 5-nitro-barbituric acid salt, triaminoguanidine 5-nitro-barbituric acid salt, and mixtures thereof, and sub-micron fumed silica wherein the oxidizer-fuel mixture is within about 4 percent of stoichiometric balance;

combusting the mixture, thereby producing a gas and no more than about 0.06 cubic centimeters of solids per gram of gas generating composition on combustion.

36. The method of claim 35, further comprising adding at least one of cupric oxalate hemi-hydrate and graphite to the mixture of oxidizer and fuel.

* * * * *